United States Patent [19]

Keeffe et al.

[11] Patent Number: 4,709,184

[45] Date of Patent: Nov. 24, 1987

[54] LOW WATTAGE METAL HALIDE LAMP

[75] Inventors: William M. Keeffe, Rockport; Zeya K. Krasko, Danvers, both of Mass.

[73] Assignee: GTE Products Corporation, Danvers, Mass.

[21] Appl. No.: 871,129

[22] Filed: May 30, 1986

Related U.S. Application Data

[63] Continuation of Ser. No. 642,009, Aug. 20, 1984, abandoned.

[51] Int. Cl.[4] ..... H01J 17/20

[52] U.S. Cl. ..... 313/638; 313/620; 313/639; 313/642; 313/633

[58] Field of Search ..... 313/25, 54, 620, 638, 313/639, 642, 623, 633

[56] References Cited

U.S. PATENT DOCUMENTS

| | | | |
|---|---|---|---|
| Re. 27,953 | 3/1974 | Gungle et al. | 313/184 |
| 3,262,012 | 7/1966 | Koury et al. | 313/639 |
| 3,351,798 | 11/1967 | Bauer | 313/225 |
| 3,407,327 | 10/1968 | Koury et al. | 313/229 |
| 3,832,591 | 8/1974 | Larson | 313/639 |
| 3,898,504 | 8/1975 | Akutsu et al. | 313/639 |
| 4,161,672 | 7/1979 | Cap et al. | 313/620 |
| 4,245,175 | 1/1981 | McAllister | 313/639 |
| 4,298,813 | 11/1981 | Johnson | 313/639 |
| 4,374,339 | 2/1983 | Tielemans et al. | 313/642 |
| 4,387,319 | 6/1983 | White et al. | 313/620 |
| 4,499,396 | 2/1985 | Fohl et al. | 313/25 |

FOREIGN PATENT DOCUMENTS

| | | | |
|---|---|---|---|
| 0773221 | 12/1967 | Canada | 313/250 |
| 2410162 | 9/1974 | Fed. Rep. of Germany | 313/639 |
| 0038268 | 12/1975 | Japan | 313/639 |
| 0094467 | 8/1978 | Japan | 313/642 |
| 0025085 | 8/1978 | Japan | 313/638 |
| 0017552 | 1/1982 | Japan | 313/638 |

*Primary Examiner*—Leo H. Boudreau
*Assistant Examiner*—Michael Razavi
*Attorney, Agent, or Firm*—Martha Ann Finnegan; Thomas H. Buffton

[57] ABSTRACT

A low wattage metal halide discharge lamp includes a sealed outer envelope with a pair of electrical conductors passing therethrough and containing an arc tube having a pair of electrodes electrically connected to the pair of electrical conductors with a chemical fill within the arc tube including iodides of sodium and scandium of a molar ratio in the range of about 20:1 to 28:1.

22 Claims, 4 Drawing Figures

LOW WATTAGE METAL HALIDE LAMP

This is a continuation of co-pending application Ser. No. 642,009 filed on Aug. 20, 1984 now abandoned.

TECHNICAL FIELD

This invention relates to low wattage metal halide lamps and more particularly to the configuration and chemical fill of low wattage metal halide lamps.

BACKGROUND ART

Generally, metal halide discharge lamps available in todays market are of the intermediate or high wattage variety, i.e., 175 to 1500 watts for example. Also, these higher wattage metal halide lamps have the higher efficacy which is directly related to efficiency and conveniently defined as the ratio of total lumen output to input power as expressed in lumens per watt. Moreover, it is known that the efficacy of a lamp tends to decrease as the wattage decreases. Thus, it has been generally presupposed that low wattage metal halide lamps, wattages of 100-watts or less, would be entirely unsatisfactory in so far as efficacy is concerned.

Another common practice in intermediate and relatively high wattage metal halide lamps is the provision of an inert fill gas in the outer envelope surrounding the arc tube. Accordingly, it was believed that the inert fill gas would prevent oxidation of the metal parts located in the outer envelope and increases the breakdown voltage whereby arcing would be inhibited. However, it was found that the undesired loss of heat due to convection currents made possible by the presence of the inert gas significantly reduced the efficacy of the discharge lamp.

Known attempts to reduce this undesired heat loss due to convection currents include the utilization of a glass cylinder surrounding the arc tube within the sealed envelope. However, structures which include a fill gas in the outer envelope do have undesired convection currents. Moreover, these convection currents and the accompanying heat loss are present even though a glass cylinder like arrangement is employed.

Further, the smallest known domestic commercialized metal halide discharge lamp is a Sylvania 175 watt lamp formed for horizontal operation only and having a color temperature of about 3000° K. This lamp has a phosphor-coated outer envelope which transforms UV radiation into visible red radiation thereby creating a relatively warm color appearance. However, the lamp undesirably requires a relatively large and cumbersome luminaire for adequate light distribution control, in addition, has the disadvantage of being operable in a horizontal position only.

OBJECTS AND SUMMARY OF THE INVENTION

An object of the present invention is to overcome the difficulties of the prior art. Another object of the invention is to provide an improved metal halide discharge lamp having relatively low wattage and reduced heat losses due to convection currents. Still another object of the invention is to provide a low wattage high efficiency metal halide discharge lamp of small size and having a color temperature of about 3000° K. A further object of the invention is to provide a chemical fill for a low wattage relatively high efficacy metal halide discharge lamp.

These and other objects, advantages and capabilities are achieved in one aspect of the invention by a low wattage metal halide discharge lamp having an outer glass envelope with a pair of electrical conductors sealed into and passing therethrough, an arc tube disposed within the envelope and the arc tube having a pair of spaced electrodes with each of the electrodes electrically connected to one of the pair of electrical conductors and a chemical fill within the arc tube including sodium and scandium iodides of a molar ratio in the range of about 20:1 to 28:1.

BEST MODE FOR CARRYING OUT THE INVENTION

For a better understanding of the present invention, together with other and further objects, advantages and capabilities thereof, reference is made to the following disclosure and appended claims in conjunction with the accompanying drawings.

Figure 1:
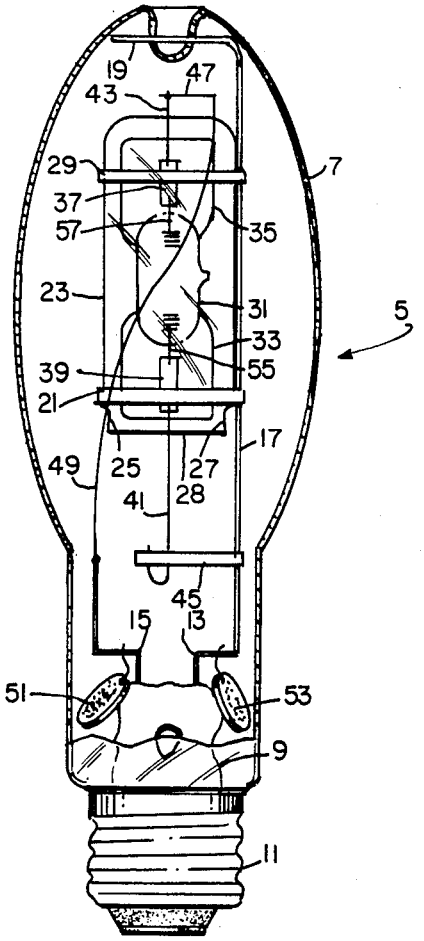
FIG. 1 is a cross-sectional view of a low wattage metal halide discharge lamp of the invention.

Referring to FIG. 1 of the drawings, a low wattage metal halide arc discharge lamp 5 importantly includes an evacuated outer envelope 7. This evacuated outer envelope 7 is hermetically sealed to a glass stem member 9 having an external base member 11 affixed thereto. A pair of electrical conductors 13 and 15 are sealed into and pass through the stem member 9 and provide access for energization of the discharge lamp 5 by an external source (not shown).

Within the vacuum of the evacuated outer envelope 7, a support member 17 is affixed to one of the electrical conductors 13 and extends substantially parallel to the longitudinal axis of the lamp 5 and forms a circular configuration 19 near the upper portion of the envelope 7. This circular configuration 19 in conjuction with the upper portion of the envelope 7 tends to maintain the support member 17 in proper alignment and resistant to deformation caused by external shock.

A first strap member 21 is welded to the support member 17 and extends therefrom in a direction normal to the longitudinal axis and the direction of the support member 17. A domed quartz sleeve or temperature equalizing means 23 has a pair of oppositely disposed notches 25 and 27 on the end thereof 28 opposite to the dome portion. These notches 25 and 27 are formed to slip over the first strap member 21 which serves to support the domed quartz sleeve 23. Also, a substantially circular shaped strap 29 surrounds the domed quartz sleeve 23 near the domed portion thereof and is attached to the support member 17.

Within the temperature equalizing means or domed quartz sleeve 23 is an arc tube 31 having a chemical fill including elemental scandium and mercury, sodium, scandium and cesium iodides and an inert gas. The arc tube 31 has a pinch seal at opposite ends thereof, 33 and 35 respectively. Metal foil members 37 and 39 are sealed into the press seals 33 and 35 and electrical conductors 41 and 43 are attached to the foil members 37 and 39 and extend outwardly from the press seals 33 and 35. A flexible support member 45 is affixed to one of the electrical conductors 41 and to the support member 17. Also, lead 47 is affixed to the other electrical conductor 43 which passes through the domed portion of the domed quartz sleeve 23. Moreover, a flexible spring-like member 49 connects the lead 47 to the other one 15 of the pair of electrical conductors 13 and 15. A pair of getters 51 and 53 are affixed to the electrical conductors 13 and 15 and serve to provide and maintain the vacuum within the evacuated outer envelope 7 and the domed quartz sleeve 23.

Referring to the arc tube 31, a preferred configuration, suitable for use in a metal halide lamp of a size in the range of about 40 to 150 watts for example, would have an inner diameter of about 10 mm and an arc length between the electrodes 41 and 43 of about 14 mm. Also, it may be noted that each of the ends of the arc tube 31 immediately adjacent and including the press seals 33 and 35 is coated with a white zirconium oxide paint in order to provide a wall temperature of increased uniformity. Moreover, it has been found that a wall loading in the range of about 14 to 17 watts/cm$^2$ is preferable and now attainable in metal halide lamps of a size in the range of about 40 to 150-watts, and of the above-mentioned configuration.

Figure 2:
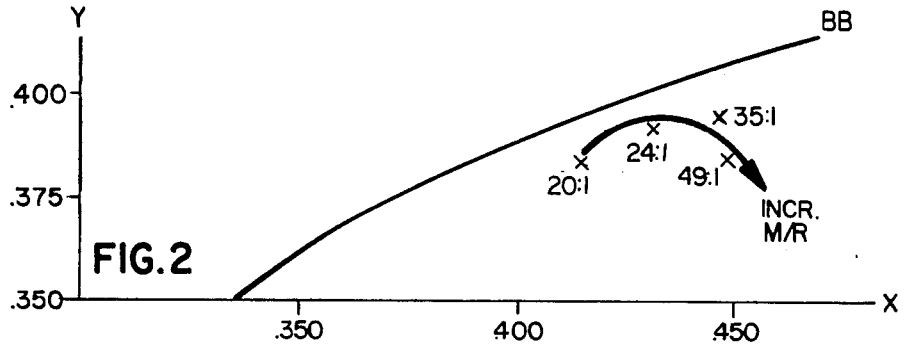
FIG. 2 is chromaticity coordinate chart for molar ratios of sodium iodide to scandium iodide.

Referring to the chemical fill of the above-mentioned discharge lamp configuration, the comparison graph of FIG. 2 illustrates various ratios of sodium and scandium iodides as plotted on chromaticity coordinates (x and y) of a standard chromaticity chart. As can readily be seen on the graph, the molar ratio of sodium to scandium iodide which most closely approaches the highly desirable black body (BB) curve representative of the output of an incandescent lamp is a molar ratio in the range of about 20:1 to 28:1. More specifically, a sodium to scandium iodide molars ratio of about 24:1 appears to be a highly desirable fill condition for metal halide discharge lamps. Moreover, it is to be noted that the above-mentioned highly desirable sodium to scandium iodide molar ratios are biased toward the red side (below the BB curve) which is preferable in terms of general illumination applications.

Figure 3:
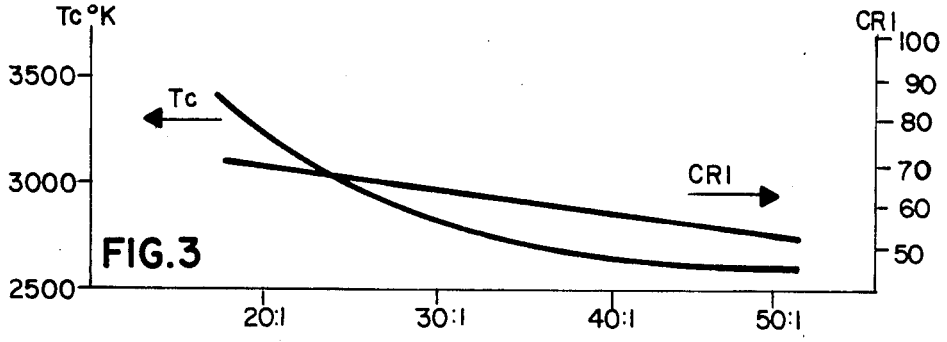
FIG. 3 is a chart illustrating the color temperature (Tc) and color rendering index (CRI) for molor ratios of sodium iodide and scandium iodide.

Also, the color temperatures (Tc) and general color rendering index (CRI) for the above-mentioned lamps having various molar ratios is illustrated in FIG. 3. As can be seen, the previously-mentioned desirable molar range of about 20:1 to 28:1 of sodium to scandium iodides provides a desired color temperature of about 3000° K. within a range of not more or less than about 200° K. Moreover, the sodium to scandium iodide molar ratio of about 24:1 appears to very closely approach the desired 3000° K. color temperature.

Further, the comparison graph of FIG. 3 also illustrates the constant color rendering index (CRI) at various molar ratios of sodium to scandium iodide. Again, it can be seen that a molar ratio of about 24:1 approaches a highly desirable value of about 65.0 on the CRI index with the range of molar ratios of about 20:1 to 28:1 not varying from the preferred value of 65.0 by not more or less than about 2.0 indices.

Figure 4:
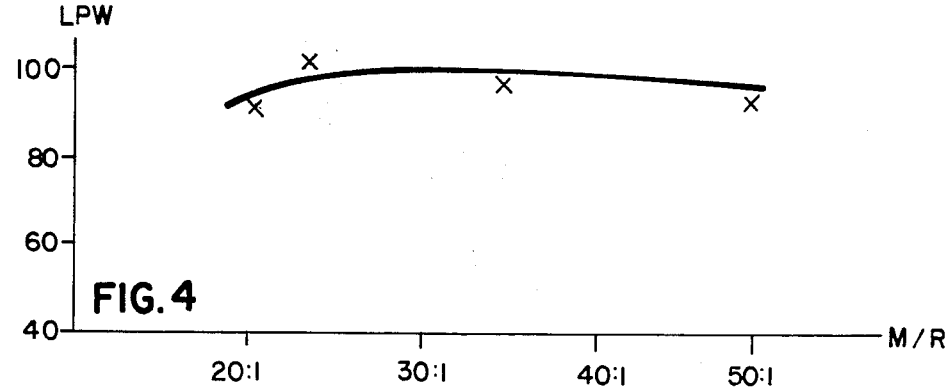
FIG. 4 is a comparison chart illustrating the lumens per watt of low wattage metal halide discharge lamps at various sodium to scandium iodide molar ratios.

Also, the lamp efficiency at the above-mentioned varying molar ratios of sodium to scandium iodides is illustrated in FIG. 4. Herein it can be seen that a sodium to scandium iodide molar ratio of about 24:1 provides a desirable efficiency of about 100 lumens per watt (LPW). Moreover, this desirable 100 LPW capability remains substantially constant over a sodium to scandium iodide molar ratio in the range of about 20:1 to 28:1.

Further, tests were run to determine an optimum dosage of sodium to scandium iodide at a molar ratio of about 24:1. Employing a lamp having an arc tube volume of about 1 cm$^3$ and varying to salt dosage from about 8 to 20 mg, it was found that a dosage of about 12 mg/cm$^3$ at the preferred molar ratio of about 24:1 yielded the highest lumens per watt and color rendering index (CRI). At dosages of a weight less than about 12 mg, it was found that the desired color rendering index (CRI) could not be sustained while dosages greater than about 12 mg resulted in poor lumen maintenance and a shortened lamp life. Moreover, it was found that a dosage of about 12 mg/cm$^3$ was most appropriate for lamps in the range of about 40 to 150 watts.

Additionally, it has been found that the incorporation of cesium iodide into the lamp dosage enhances the starting time of the discharge lamp. Upon the inclusion of cesium iodide in the range of about 0.3 to 1.0 mg in the above-mentioned lamps, it was found that the lamp starting could be reduced from an average of about one to one and one-half (1–1 ½) minutes without the cesium iodide to virtual instantaneous starting (less than 1-sec) when a dosage of about 0.5 mg was employed. Lesser amounts of cesium iodide provide much smaller improvements in starting time while greater amounts tended to degrade lamp efficiency and warm color charactertistics. Thus, the preferred dosage for a metal halide discharge lamp having a volume of about 1 cm$^3$ and a wattage in the range of about 40 to 150 watts includes about 12 mg of sodium, scandium and cesium iodides in the molar ratio of about 24:1:0.6.

In addition to the above-mentioned components, it has been determined that a weight dosage of about 100 micrograms/cm$^3$ of elemental scandium, elemental mercury in accordance with the formula:

$$N(\mathrm{Hg})(\mathrm{mg/cm^3}) = 7.7D^{1/7}$$

where D=arc tube diameter in millimeters and argon gas at a pressure of about 100 torr are most appropriate to the above mentioned metal halide lamps of about 40 to 150 watts. Thus, a discharge lamp of enhanced color temperature, starting capability, extended life and efficiency is attainable in wattages less than previously known.

While there has been shown and described what is at present considered the preferred embodiments of this invention, it will be obvious to those skilled in the art that various changes and modifications may be made therein without departing from the invention as defined by the appended claims.

We claim:

1. A low wattage metal halide discharge lamp comprising:

an outer sealed glass envelope;

a pair of electrical conductors sealed into and passing through said glass envelope;

an arc tube disposed within said outer glass envelope, said arc tube having a pair of spaced electrodes therein with each electrode electrically connected to one of said pair of electrical conductors; and a chemical fill disposed within said arc tube, said fill consisting essentially of sodium iodide and scandium iodide in a molar ratio in the range of about 20:1 to 28:1, elemental mercury, scandium, and an inert gas.

2. The low-wattage metal halide discharge lamp of claim 1 wherein said chemical fill further consists essentially of cesium iodide.

3. The low wattage metal halide discharge lamp of claim 2 wherein said sodium iodide, scandium iodide, and cesium iodide are in a molar ratio of about 24:1:0.6.

4. The low wattage metal halide discharge lamp of claim 1 wherein said discharge lamp is of a size in the range of about 40 to 150 watts.

5. The low wattage metal halide discharge lamp of claim 1 wherein said discharge lamp includes an evacuated sealed glass envelope and a temperature equalizing means within said envelope and surrounding said arc tube.

6. The low wattage metal halide discharge lamp of claim 1 wherein said cesium iodide is present in a weight dosage of about 0.5 mg/cm$^3$.

7. The low wattage metal halide discharge lamp of claim 1 wherein said chemical fill further consists essentially of cesium iodide, and said sodium iodide, scandium iodide, and cesium iodide are of a weight dosage of about 12 mg/cm$^3$.

8. The low wattage metal halide discharge lamp of claim 1 wherein said elemental scandium is present in a weight dosage in the range of about 90 to 110 micrograms/cm$^3$.

9. The low wattage metal halide discharge lamp of claim 1 wherein said inert gas is at a pressure of about 100 torr.

10. The low wattage metal halide discharge lamp of claim 1 wherein said elemental mercury is present at a weight dosage in accordance with the formula:

$$N\,(\mathrm{Hg})\ (\mathrm{mg/cm^3}) = 7.7\ D^{1/7}$$

wherein: D=arc tube inner diameter in millimeters.

11. The low wattage metal halide discharge lamp of claim 1 wherein said discharge lamp has a color temperature of about 3000° K. within a range of not more nor less than about 200° K.

12. The low wattage metal halide discharge lamp of claim 1 wherein said lamp has a color rendering index (CRI) of about 65 within a range of not more nor less than about 2.0 indices.

13. The low wattage metal halide discharge lamp of claim 1 wherein said arc tube has a wall loading in the range of about 14 to 17 watts/cm$^2$.

14. A metal halide discharge lamp in the range of about 40 to 150 watts comprising:

an evacuated outer envelope;

a pair of electrical conductors sealed into and passing through said outer envelope;

an arc tube disposed within said outer envelope and having a pair of spaced electrodes with each of said electrodes electrically connected to one of said pair of electrical conductors;

a domed quartz sleeve telescoped over said arc tube within said outer envelope; and a chemical fill within said arc tube, said fill consisting essentially of elemental scandium, elemental mercury, an inert gas, and iodides of sodium, scandium, and cesium with said sodium and scandium iodides being of a molar ratio in the range of about 20:1 to 28:1.

15. The metal halide discharge lamp of claim 14 wherein said sodium, scandium and cesium iodides are of a molar ratio of about 24:1:0.6.

16. The metal halide discharge lamp of claim 14 wherein said cesium iodide is of a dosage of about 0.5 mg/cm$^3$.

17. The metal halide discharge lamp of claim 14 wherein said iodides of sodium, scandium and cesium are of a dosage of about 12 mg/cm$^3$.

18. The metal halide discharge lamp of claim 14 wherein said elemental scandium is of a dosage in the range of about 90 to 110 micrograms/cm$^3$.

19. The metal halide discharge lamp of claim 14 wherein said inert gas is argon at a pressure of about 100 torr.

20. The low wattage metal halide discharge lamp of claim 14 wherein said elemental mercury is present at a weight dosage in accordance with the formula:

$$N(\mathrm{Hg})(\mathrm{mg/cm^3}) = 7.7D^{1/7}$$

wherein: D=arc tube inner diameter in millimeters.

21. The metal halide discharge lamp of clamp 14 wherein said lamp has a color temperature of about 3000° K. within a range of not more than or less than about 200° K.

22. The metal halide discharge lamp of claim 14 wherein said arc tubes has a wall loading in the range of about 14 to 17 watts/cm$^2$.

* * * * *